US007392574B2

(12) United States Patent
Bovard et al.

(10) Patent No.: US 7,392,574 B2
(45) Date of Patent: Jul. 1, 2008

(54) MEMORIALIZATION CASKET

(75) Inventors: Christopher C. Bovard, Sunman, IN (US); Todd K. Dennis, Batesville, IN (US); Jon E. Doyle, Batesville, IN (US); Thomas F. Heil, Batesville, IN (US); Paul A. Holzman, Mason, OH (US); Daniel J. Parker, Connersville, IN (US); Christopher R. Ruberg, Batesville, IN (US); Greg Wray, Guilford, IN (US)

(73) Assignee: Batesville Services, Inc., Batesville, IN (US)

( * ) Notice: Subject to any disclaimer, the term of this patent is extended or adjusted under 35 U.S.C. 154(b) by 181 days.

(21) Appl. No.: 11/096,599

(22) Filed: Apr. 1, 2005

(65) Prior Publication Data

US 2006/0048354 A1 Mar. 9, 2006

Related U.S. Application Data

(63) Continuation-in-part of application No. 10/687,132, filed on Oct. 16, 2003, now Pat. No. 7,316,053.

(51) Int. Cl.
*A61G 17/00* (2006.01)

(52) U.S. Cl. ..... 27/14; 27/2

(58) Field of Classification Search ..... 27/19, 27/2, 14, 4; D99/1, 2, 8, 9
See application file for complete search history.

(56) References Cited

U.S. PATENT DOCUMENTS

| | | | | |
|---|---|---|---|---|
| 443,209 | A | 12/1890 | Ripsom | |
| 458,527 | A | 8/1891 | Freshl | |
| 494,297 | A | 3/1893 | Leonhardt | |
| 504,009 | A | 8/1893 | Whitney | |
| 545,176 | A | 8/1895 | Ruebekam | |
| 2,159,144 | A | 5/1939 | Fletcher | 27/12 |
| 2,526,793 | A | 10/1950 | Alfred | 311/103 |
| 2,604,369 | A | 7/1952 | Phillips et al. | 311/16.5 |
| 4,177,543 | A | 12/1979 | Angermann | 27/35 |
| 4,457,054 | A | 7/1984 | Craft et al. | 27/1 |
| 4,788,757 | A | 12/1988 | Bethune et al. | 27/2 |
| 5,481,785 | A | 1/1996 | Minton et al. | 27/27 |
| 5,562,049 | A | 10/1996 | Hoffman et al. | 106/94 |
| 5,611,124 | A | 3/1997 | Biondo et al. | 27/2 |
| 5,675,876 | A | 10/1997 | Benedict et al. | 27/2 |
| 5,678,289 | A | 10/1997 | Saaf | 27/2 |
| 5,727,291 | A | 3/1998 | Biondo et al. | 27/2 |
| 5,749,554 | A | 5/1998 | Avila et al. | 248/311.2 |
| 5,771,814 | A | 6/1998 | Clausen | 108/93 |
| 5,956,825 | A | 9/1999 | McCoy et al. | 27/2 |
| 6,322,123 | B1 | 11/2001 | Garrison et al. | 296/26.1 |
| 6,324,736 | B1 | 12/2001 | Atrio | 27/2 |
| 6,324,737 | B1 | 12/2001 | Chamness et al. | 27/2 |
| 2006/0048353 | A1 * | 3/2006 | Brinneman | 27/2 |

* cited by examiner

*Primary Examiner*—William L. Miller
(74) *Attorney, Agent, or Firm*—Wood, Herron & Evans, LLP

(57) ABSTRACT

A casket comprises a casket shell, a casket lid closeable upon the shell, and a memorial shelf pivoted to the lid and movable to and between an extended position at which the shelf is adapted to support items of memorialization and a retracted position.

33 Claims, 19 Drawing Sheets

MEMORIALIZATION CASKET

RELATED APPLICATIONS

This application is a continuation-in-part of application Ser. No. 10/687,132 filed Oct. 16, 2003 now U.S. Pat. No. 7,316,053, which is hereby incorporated by reference herein.

FIELD OF THE INVENTION

This invention relates generally to the death care industry, and more particularly to personalized caskets for memorializing a deceased.

BACKGROUND OF THE INVENTION

There is a trend in the death care industry to make efforts towards "personalizing" the funeral products and the funeral or other memorial service purchased for the deceased to provide a more meaningful memorial experience for the family and friends of the deceased. One of the earlier attempts at providing a means of personalizing or customizing a casket to the deceased may be seen with reference to the Assignee's U.S. Pat. No. 4,457,054 titled Casket Shelf, hereby incorporated by reference herein. That patent discloses a casket shelf which is mounted to the dish assembly of the head end cap when the head end cap is in the open position. The shelf provides a surface for supporting and displaying articles of religious or personal significance to the deceased when the head end cap is open during viewing of the deceased. The shelf is removed from the dish assembly when the head end cap is closed, i.e. the shelf is not integrally formed as a part of the casket.

More recently, caskets have been provided with memorabilia drawers in which keepsakes of the deceased can not only be displayed, but can be stored as well, as disclosed in the Assignee's U.S. Pat. Nos. 5,611,124 and 5,727,291, both titled Casket Having Memorabilia Compartment and hereby incorporated by reference herein. In these patents the items of memorabilia in the drawer can be displayed when the head end cap is open during viewing of the deceased by withdrawing the drawer from the foot end cap, and can be stored by inserting the drawer into the foot end cap. The caskets of these patents are commercially available from the assignee as the MemorySafe® line of caskets.

Caskets have also been provided with memorabilia trays that pivot into and out of the casket shell in which keepsakes of the deceased can be displayed when the tray is pivoted out of the casket shell and stored when the tray is pivoted into the casket shell, as disclosed in the Assignee's U.S. Pat. No. 5,675,876, entitled Casket With Pivoting Memorabilia Tray and hereby incorporated by reference herein.

Advances have therefore been made in the area of "personalization" of funeral products. However, there continues to be room for improvement in the area of personalization in the death care industry.

SUMMARY OF THE INVENTION

The present invention is a casket comprising a casket shell, a casket lid closeable upon the shell, and a memorial shelf pivoted to the lid and movable to and between an extended position at which the shelf is adapted to support items of memorialization and a retracted position.

The lid can have a downwardly facing flange and the shelf can be pivoted to the lid flange. The casket can include head and foot end lids and the shelf can be pivoted to the foot end lid. The shelf can be pivoted to the foot end lid flange. The shelf can be pivoted to the foot end lid flange adjacent a head end edge thereof. The shelf can be pie-shaped. The pie-shaped shelf can have two straight sides and an arcuate side, and the shelf can be pivoted to the foot end lid adjacent where the two straight sides intersect. The foot end lid can be pivoted to the shell with hinges along a hinge side of the lid and the pie-shaped shelf can be pivoted to the foot end lid adjacent the hinge side of the lid. The lid can include a brace which supports the shelf when in the extended position. The shell can include a removable brace which supports the shelf when in the extended position.

In another aspect, the present invention is a casket comprising a casket shell, head end and foot end casket lids closeable upon the shell, and a memorial shelf pivoted to the foot end lid and movable to and between an extended position at which the shelf is adapted to support items of memorialization and a retracted position.

The foot end lid can be pivoted to the shell along a hinge side of the lid, and the shelf can be pivoted to the foot end lid adjacent the hinge side of the lid. The foot end lid can have a free side and the shelf, when extended, can extend less than entirely from the hinge side of the foot end lid to the free side of said foot end lid. The casket can further include an overthrow having a first section overlying an upwardly facing surface of the foot end lid and a second section extending downwardly from a head end edge of the first section downwardly into the shell. The second section can include a generally vertically oriented slit therein permitting that portion of the second section which corresponds to the shelf to be tucked in behind the shelf when the shelf is in the extended position.

In another aspect, the present invention is a casket comprising a casket shell, a casket lid closeable upon the shell, and a memorialization shelf operably associated with at least one of the shell and the lid, the memorialization shelf being movable to and between an extended position where the shelf is adapted to support items of memorialization for display, and a retracted position where the items of memorialization cannot be supported thereon.

These and other features and advantages of the present invention will become more readily apparent during the following detailed description taken in conjunction with the drawings herein, in which:

BRIEF DESCRIPTION OF THE DRAWINGS OF THE INVENTION

DETAILED DESCRIPTION OF A PREFERRED EMBODIMENT OF THE INVENTION

Figure 1:
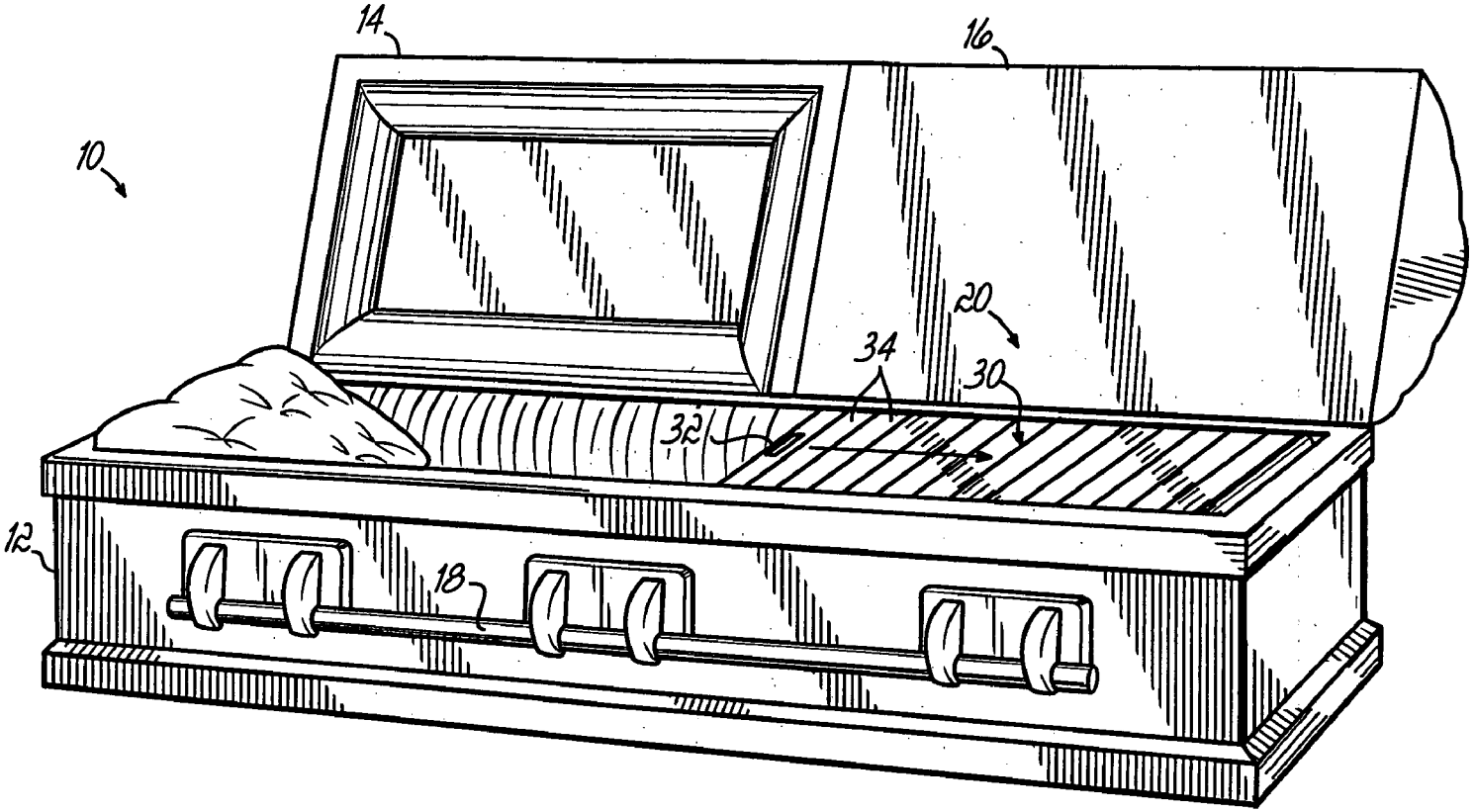
FIG. 1 is a perspective view of one embodiment of the present invention.
Figure 2A:
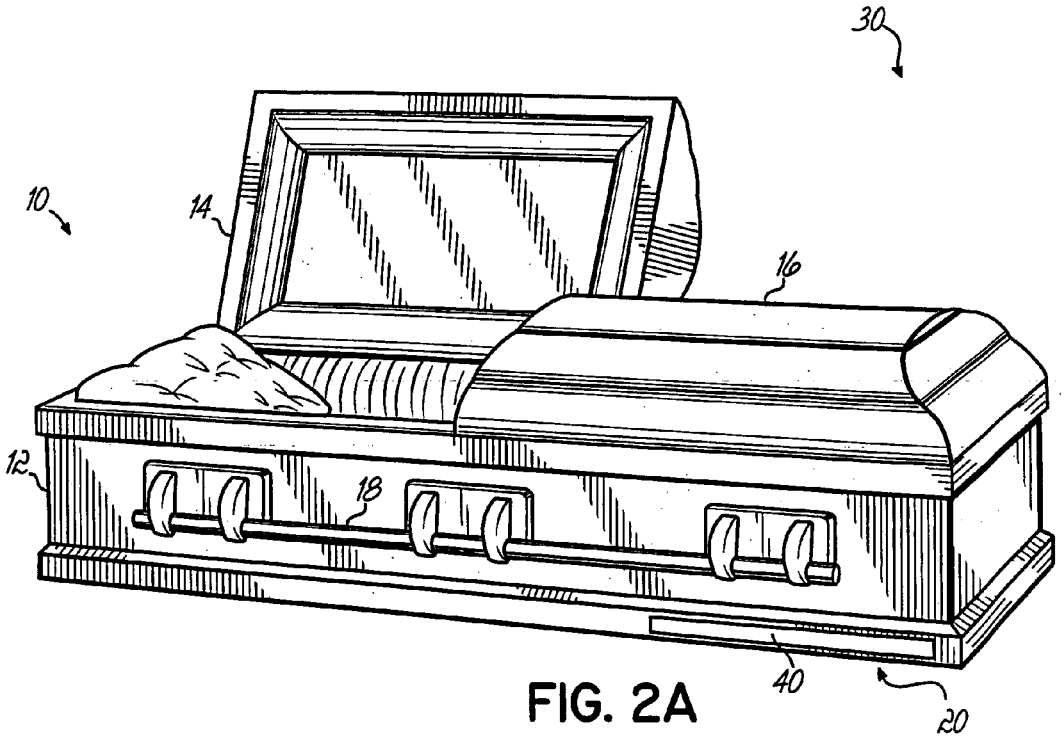
FIGS. 2A and 2B are perspective views of another embodiment.
Figure 2B:
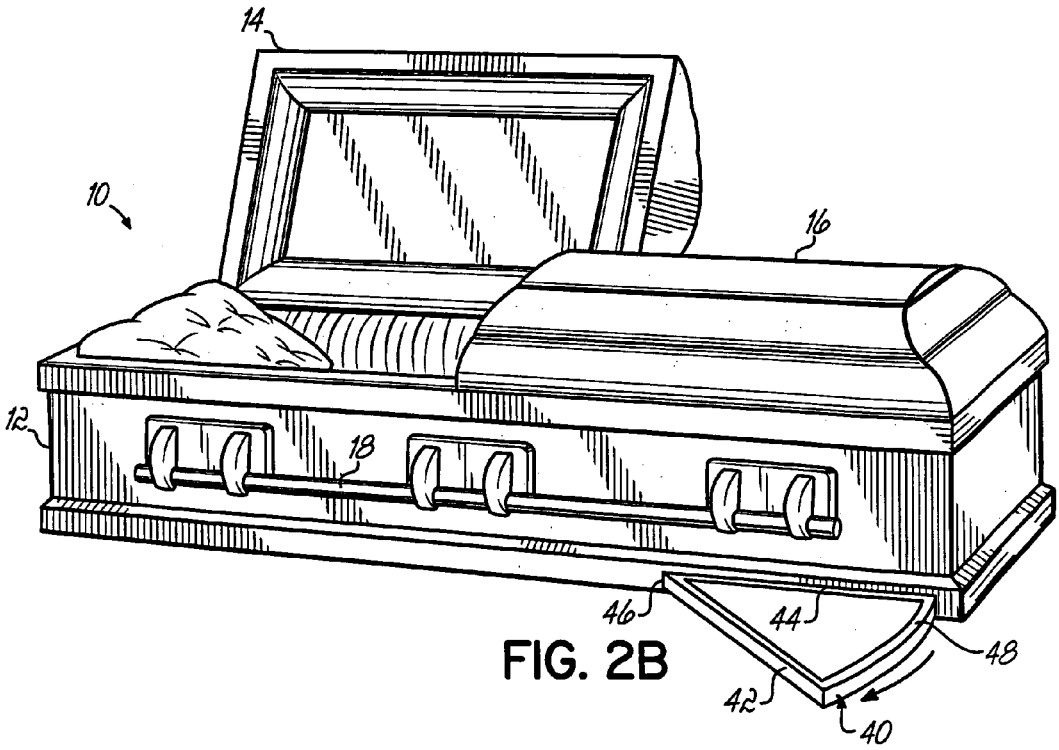
Figure 3A:
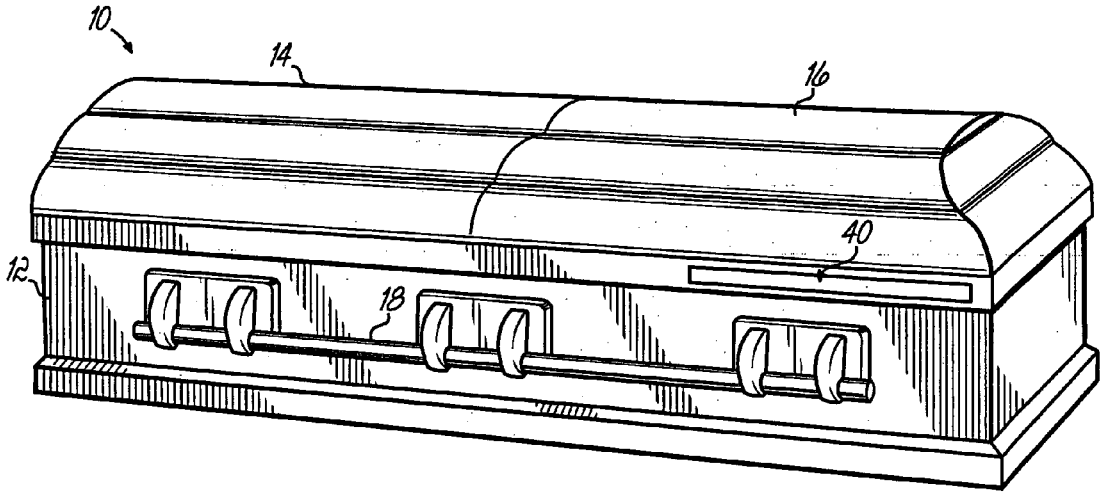
FIGS. 3A and 3B are perspective views of another embodiment.
Figure 3B:
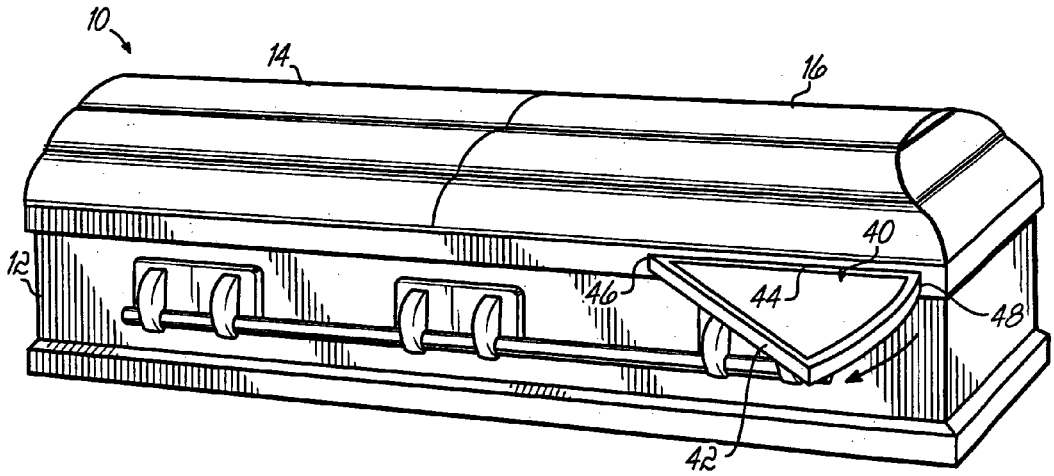

Referring first to FIG. 1, there is illustrated a casket 10 according to the present invention. Casket 10 includes a shell 12, a head end lid 14, a foot end lid 16 and handling structure 18. Casket 10 further includes deployable structure 20 which, when deployed, defines a memorial surface adapted to have placed thereon items of memorialization. Deployable structure 20 can either be operably associated with the shell 12 or the lid (14 and/or 16), and further is integrally formed therewith, i.e. is not a separate item but rather is constructed as a part of either the shell or lid as the case may be. As illustrated in FIG. 1, deployable structure 20 is operably associated with the shell 12, as are the other embodiments illustrated in FIGS. 2-8; the embodiments illustrated in FIGS. 9-17C have deployable structure 20 operably associated with the lid, either head end lid 14, foot end lid 16 or one-piece, full length lid 22 (FIG. 10). Furthermore, those embodiments illustrated and/or described as being associated with the head end lid 14 could just as well function in association with foot end lid 16 and vice versa, and those embodiments illustrated and/or described as being associated with either a head end lid 14 or foot end lid 16 could just as well function in association with a full length lid 22, unless otherwise indicated. Accordingly, the claims shall embrace all such variations.

Referring still to FIG. 1 (and to all the other FIGS. for that matter), structure 20 is configured and arranged such that items of memorialization must be removed therefrom when the structure is not deployed. In other words, structure 20 is intended to define merely a two-dimensional surface atop which the items of memorialization can be displayed, rather than a three-dimensional volume in which the items can be stored as well as displayed. To that end, the structure 20 of FIG. 1 takes the form of a roll-type shelf 30 mounted in the shell 12 at a foot end thereof. To deploy the shelf 30, one grasps the head end 32 of the shelf 30 and pulls the shelf 30 from the foot end of the shell 12 toward the head end of the shell 12. To move the shelf 30 into its undeployed position, the shelf 30 is moved in the opposite direction toward the foot end of the shell 12. The individual slats 34 permit the roll-type shelf to roll downwardly along the inside surface of foot end wall of the shell 12 and then forwardly toward the head end wall of the shell 12, and vice versa.

Referring now to FIGS. 2A, 2B, 3A and 3B, structure 20 takes the form of a pie-shaped shelf 40 mounted in the shell 12. Shelf 40 has first and second edges 42, 44 having first interconnected ends forming an apex 46, and second ends interconnected by a third arcuate edge 48. The shelf 40 is pivoted to the shell 12 at the apex 46, and is deployed by grasping the leading edge (edge 42 as illustrated) and pulling the shelf outwardly. The shelf 40 can be mounted to the shell 12 at the lower edge thereof (FIGS. 2A and 2B), the upper edge thereof (FIGS. 3A and 3B), the end thereof (FIGS. 2A, 2B, 3A and 3B) and/or the side thereof (FIGS. 2A, 2B, 3A and 3B).

Figure 4A:
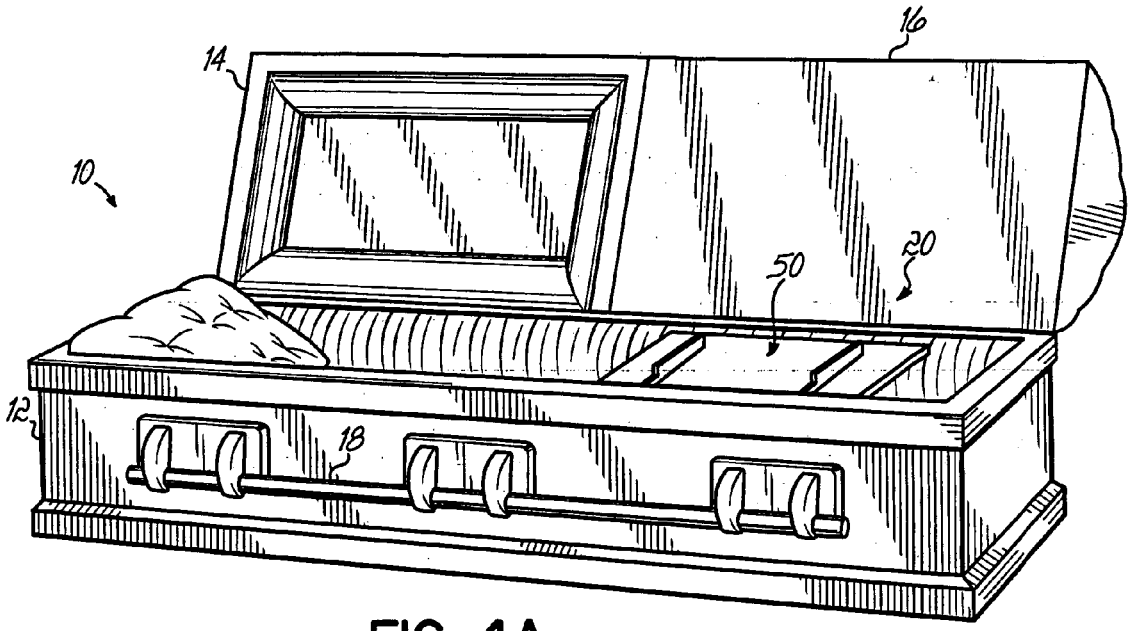
FIGS. 4A and 4B are perspective views of another embodiment.
Figure 4B:
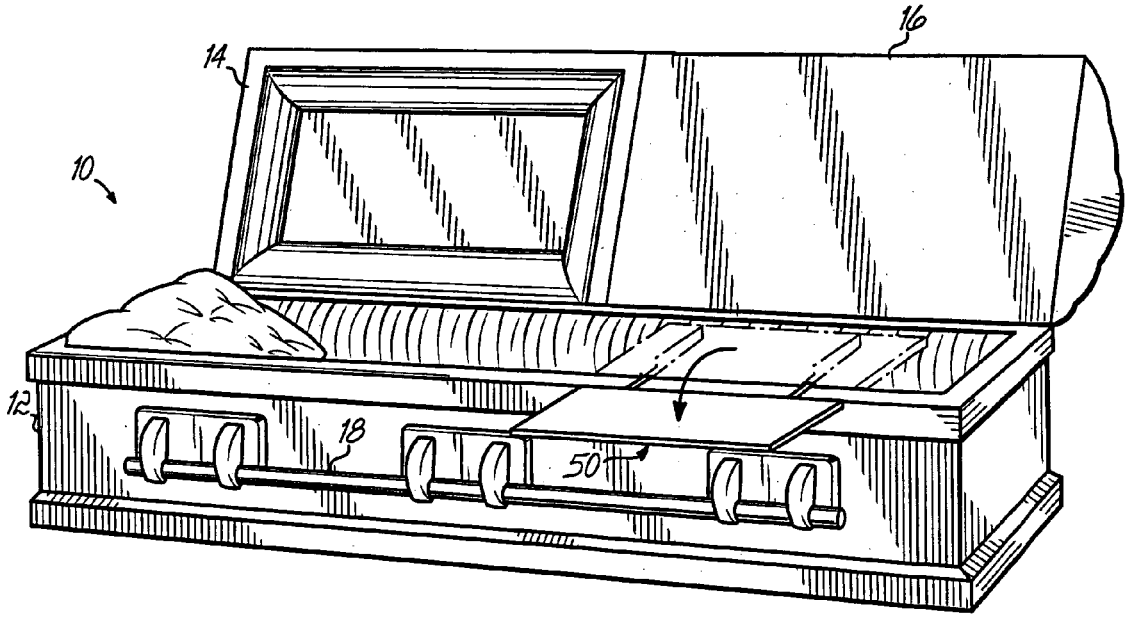

Referring now to FIGS. 4A and 4B, structure 20 takes the form of a shelf 50 pivotally mounted to the shell 12 at a forward side thereof and at an upper edge thereof. The shelf 50 is deployed by first opening (as illustrated) the foot end lid 16, pivoting the shelf 50 out of the shell 12 and then closing the lid 16.

Figure 5A:
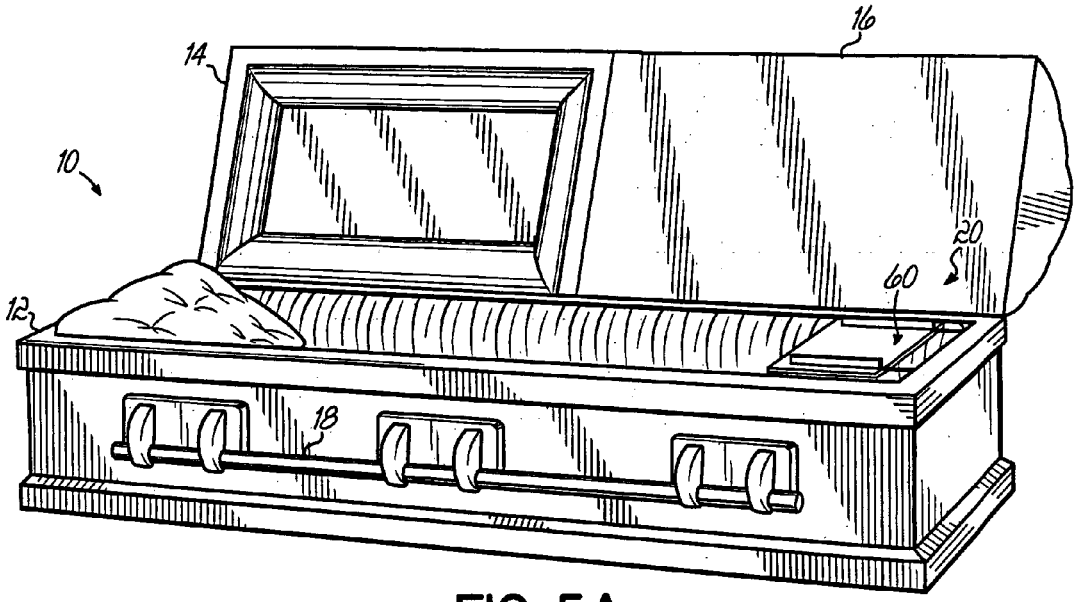
FIGS. 5A-5C are perspective views of another embodiment.
Figure 5B:
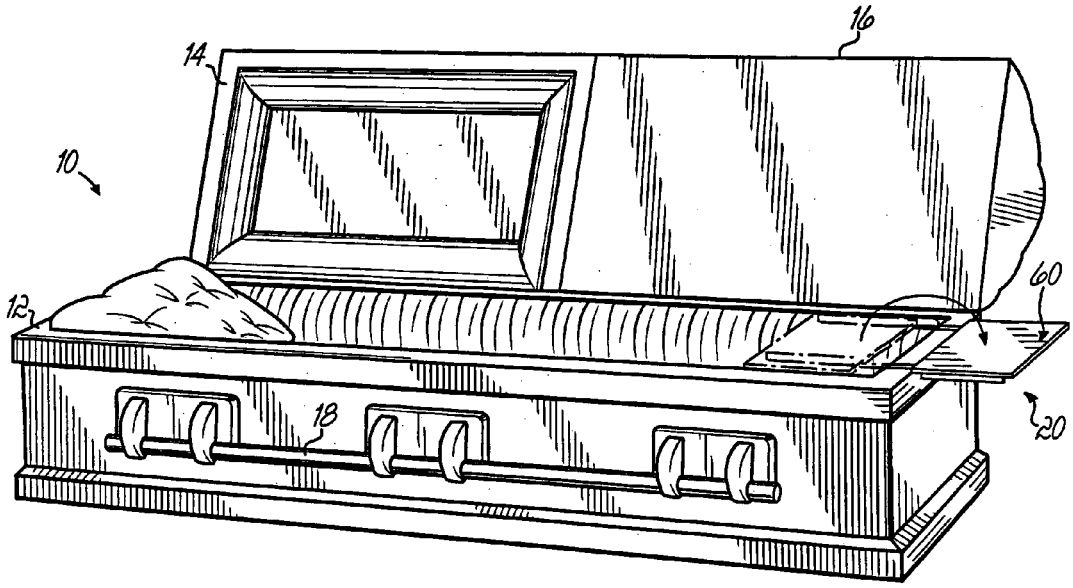
Figure 5C:
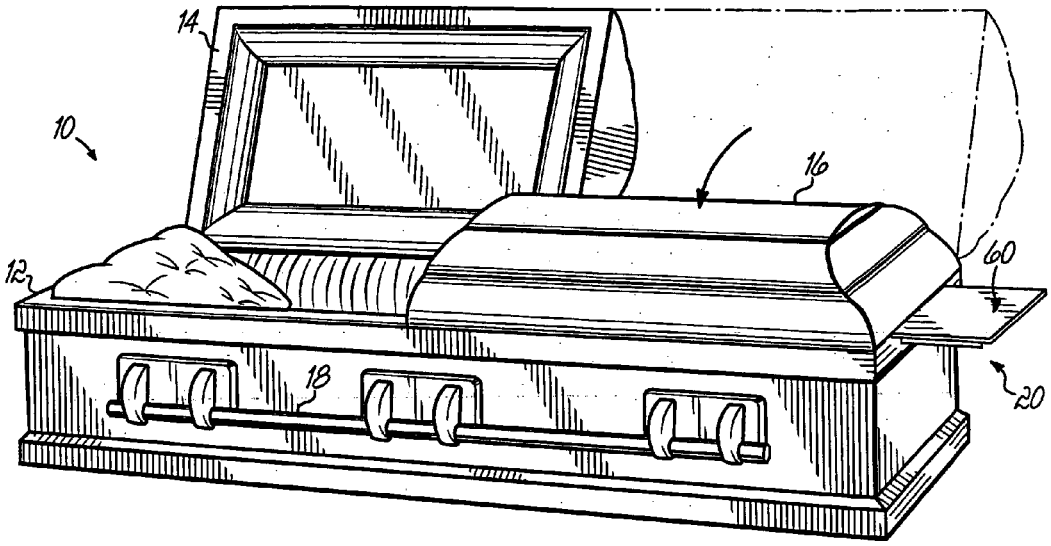

Referring now to FIGS. 5A-5C, structure 20 takes the form of a shelf 60 pivotally mounted to the shell 12 at a foot end thereof and at an upper edge thereof. The shelf 60 is deployed by first opening (as illustrated) the foot end lid 16, pivoting the shelf 60 out of the shell 12 and then closing the lid 16.

Figure 6A:
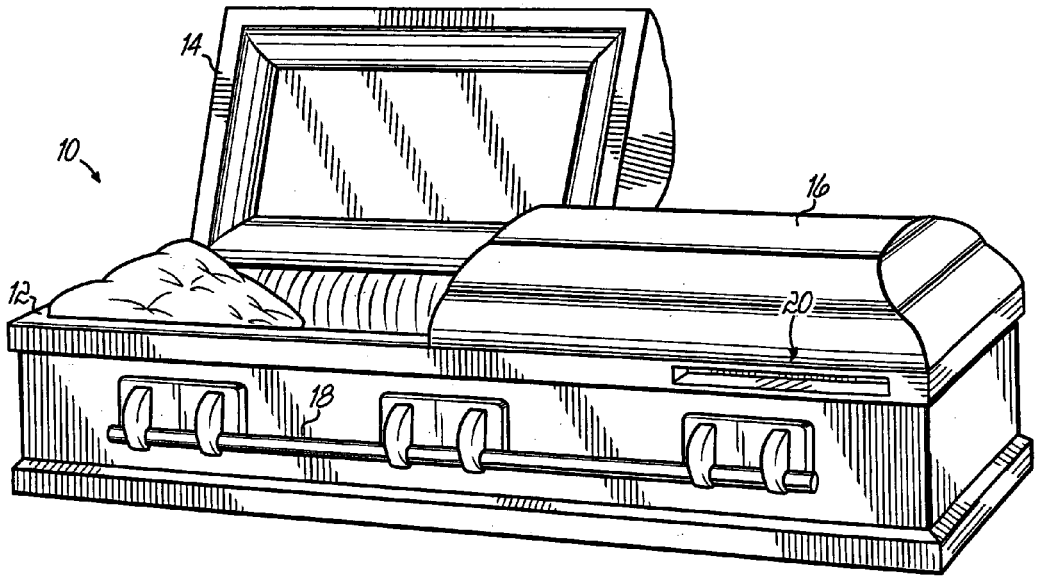
FIGS. 6A and 6B are perspective views of another embodiment.
Figure 6B:
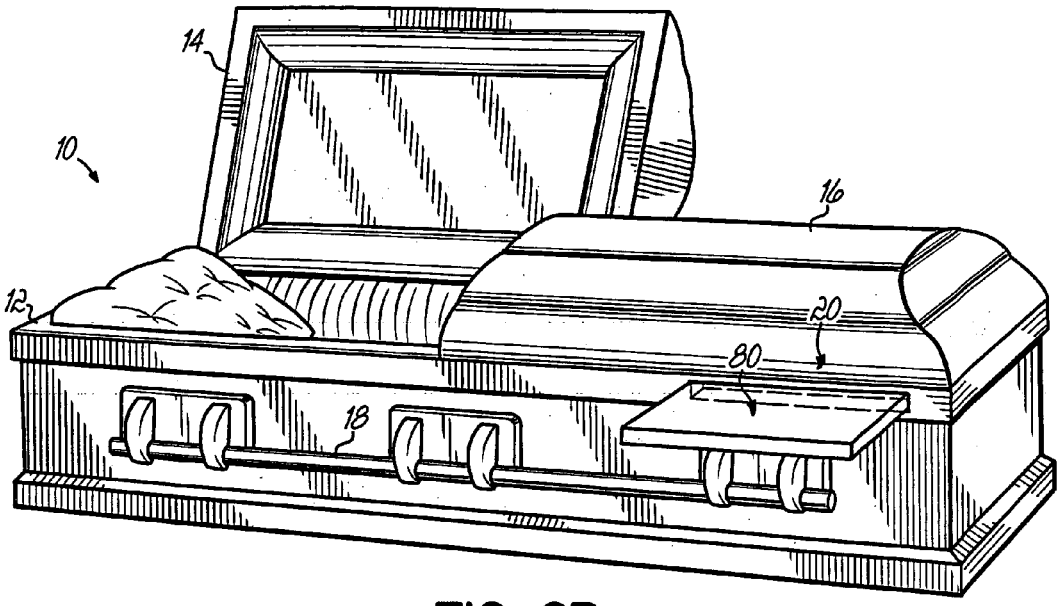
Figure 7:
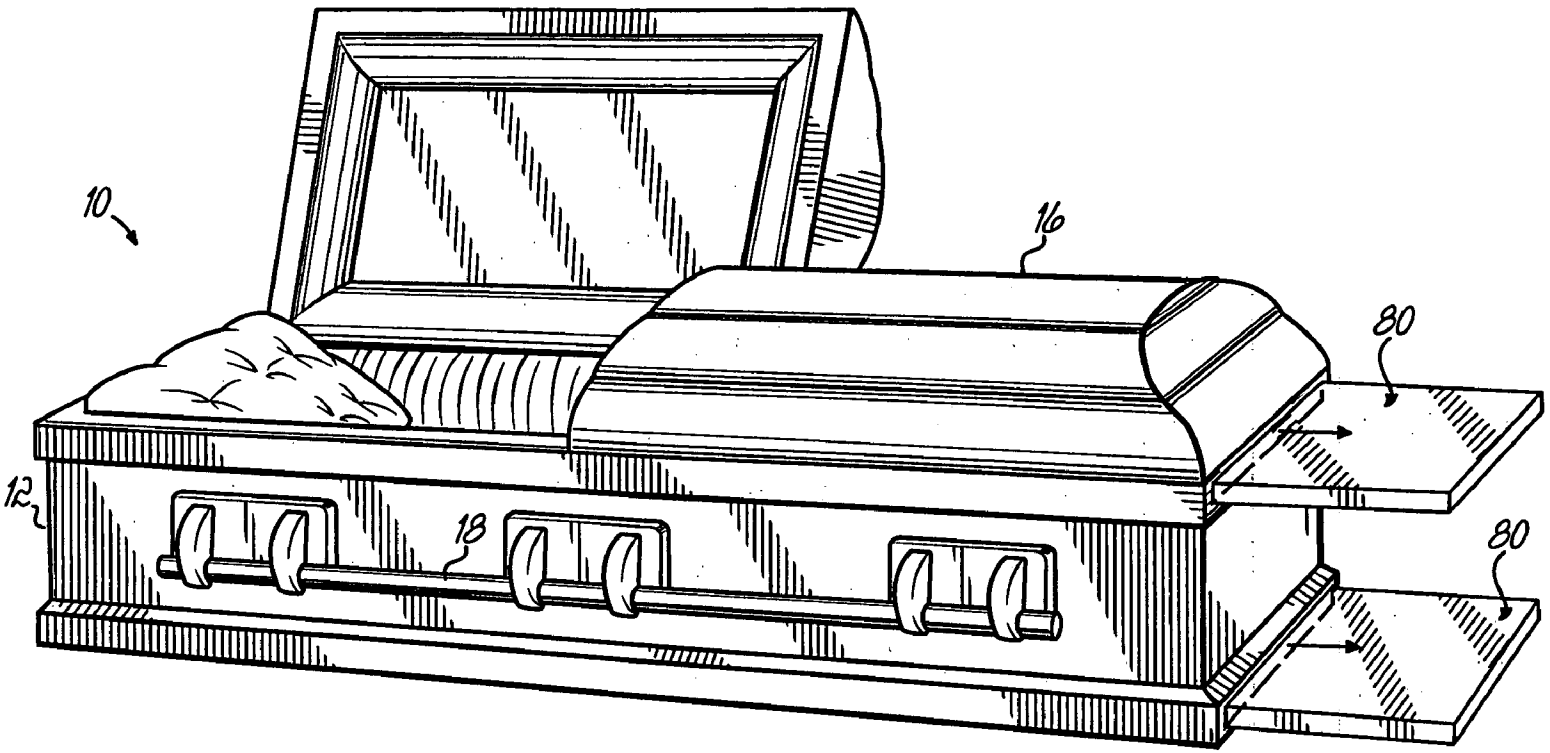
FIG. 7 is a perspective view of another embodiment.

Referring to FIGS. 6A, 6B and 7, structure 20 takes the form of a shelf 70, 80, respectively, slidably mounted in the shell 12, the shelf 70 deployed by pulling the shelf 70 out of the shell 12. The shelf 70 can be mounted in the shell 12 at an upper edge thereof (FIGS. 6A, 6B and 7), the lower edge thereof (FIG. 7), the side thereof (FIGS. 6A and 6B) and/or the end thereof (FIG. 7).

Figure 8:
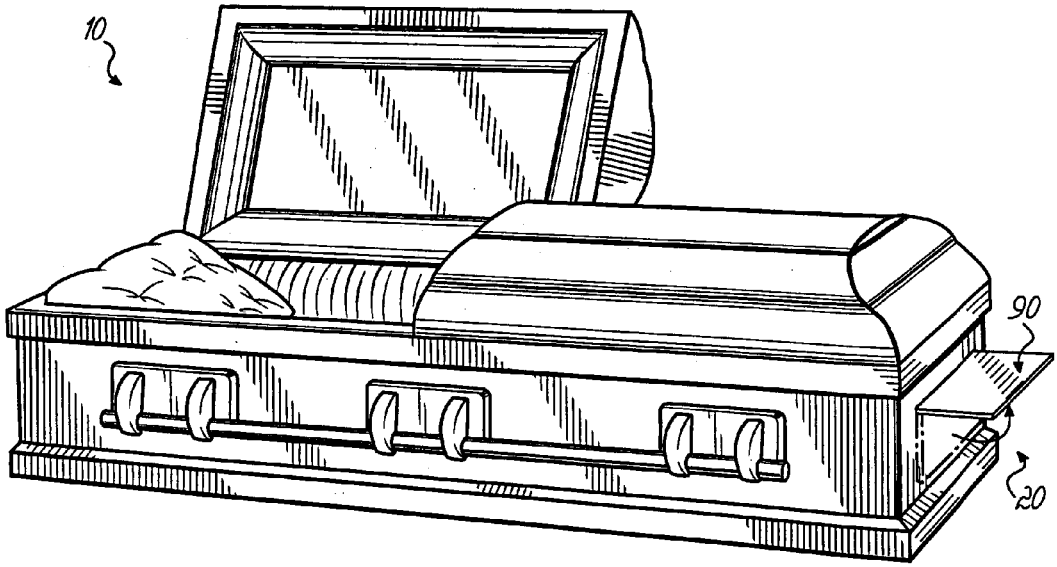
FIG. 8 is a perspective view of another embodiment.

Referring to FIG. 8, structure 20 takes the form of a shelf 90 pivotally mounted to a foot end wall of the shell 12 along an upper edge of the shelf 90. The shelf 90 is deployed by pivoting the shelf 90 away from the foot end wall.

Figure 9:
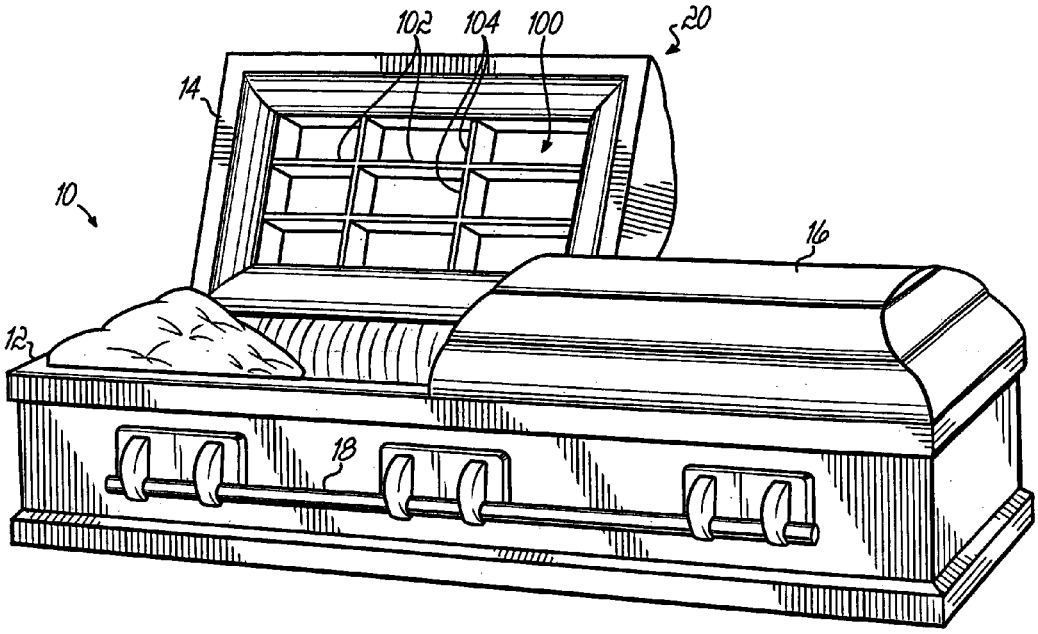
FIG. 9 is a perspective view of another embodiment.
Figure 10:
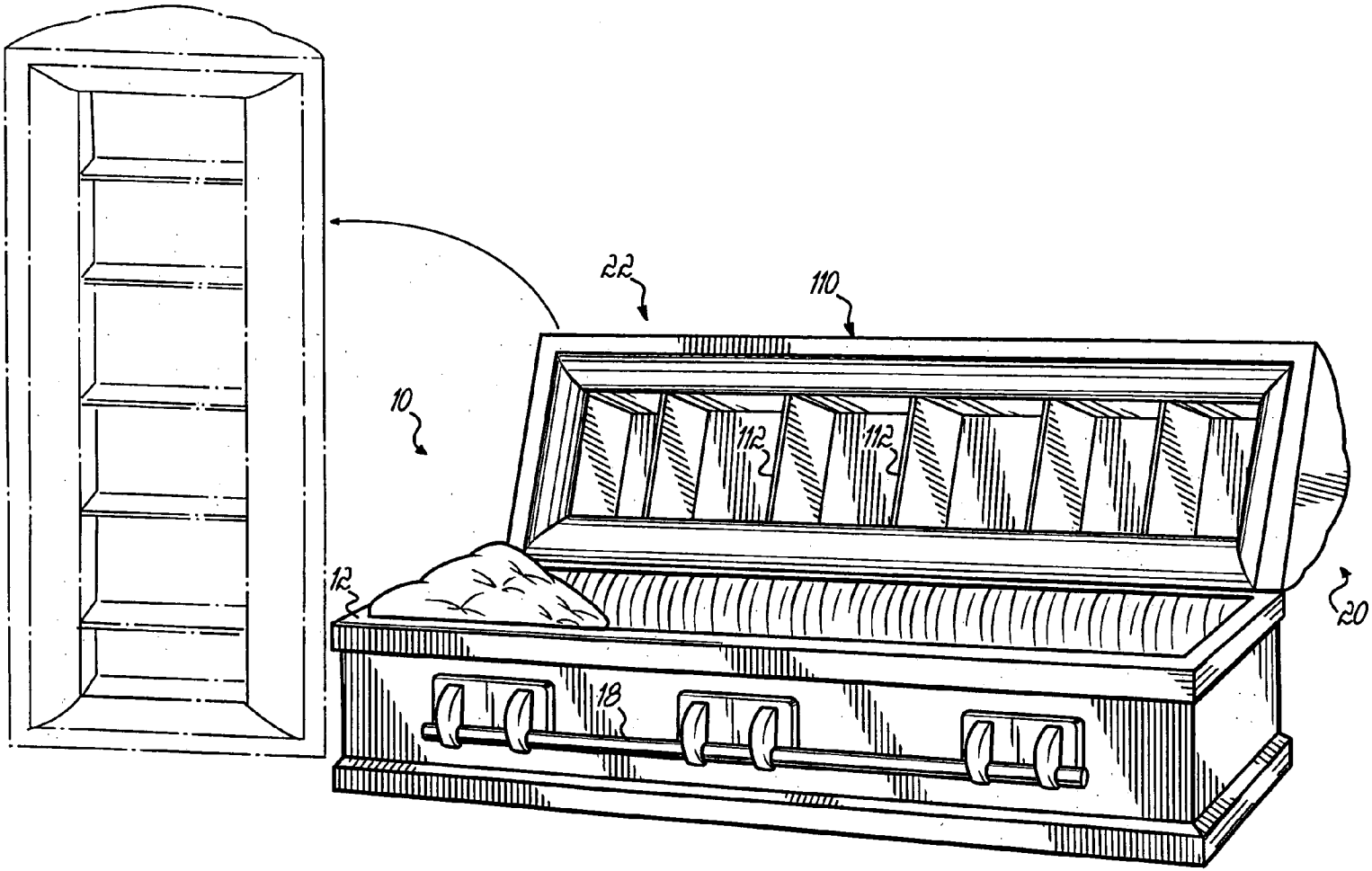
FIG. 10 is a perspective view of another embodiment.

Referring now to FIG. 9, structure 20 takes the form of a shadow box 100 mounted to an underside of head end lid 14. Shadow box 100 has a plurality of horizontal shelves 102 upon which the items of memorialization can be placed and a plurality of vertical divider panels 104 defining, with the shelves 102, a plurality of three dimensional frames within which the items of memorialization can be displayed.

Referring now to FIG. 10, casket 10 has a full length lid 22 which is readily detachable from the shell 12. When detached from shell 12, and stood upright on its end, lid 22 forms an upstanding, freestanding set of shelves 110 upon which the items of memorialization can be displayed. To that end, the lid 22 has a plurality of vertical (when attached to the shell 12) divider panels 112, which form shelves when the lid 22 is stood on its end.

Figure 11A:
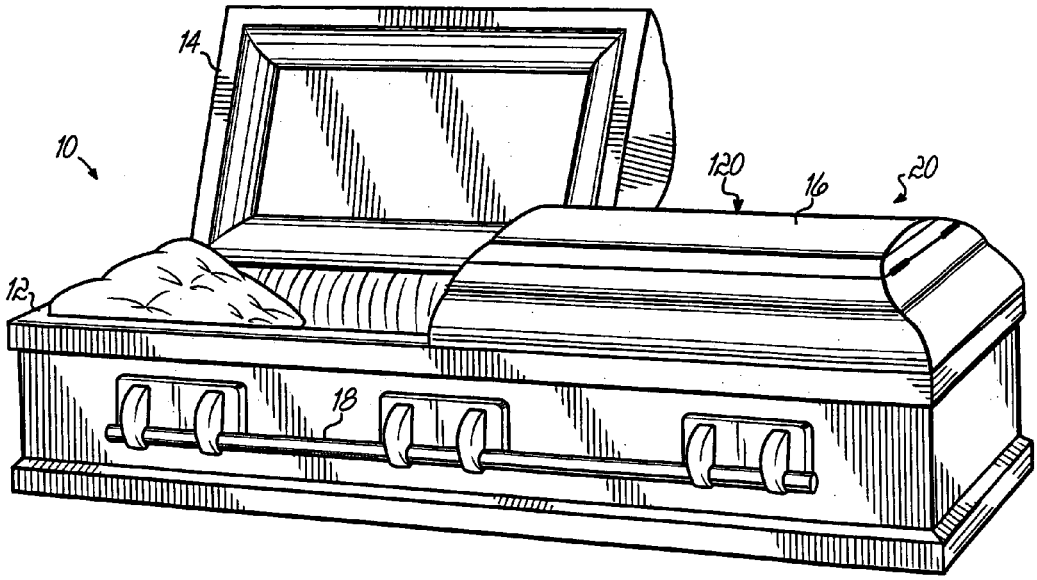
FIGS. 11A and 11B are perspective views of another embodiment.
Figure 11B:
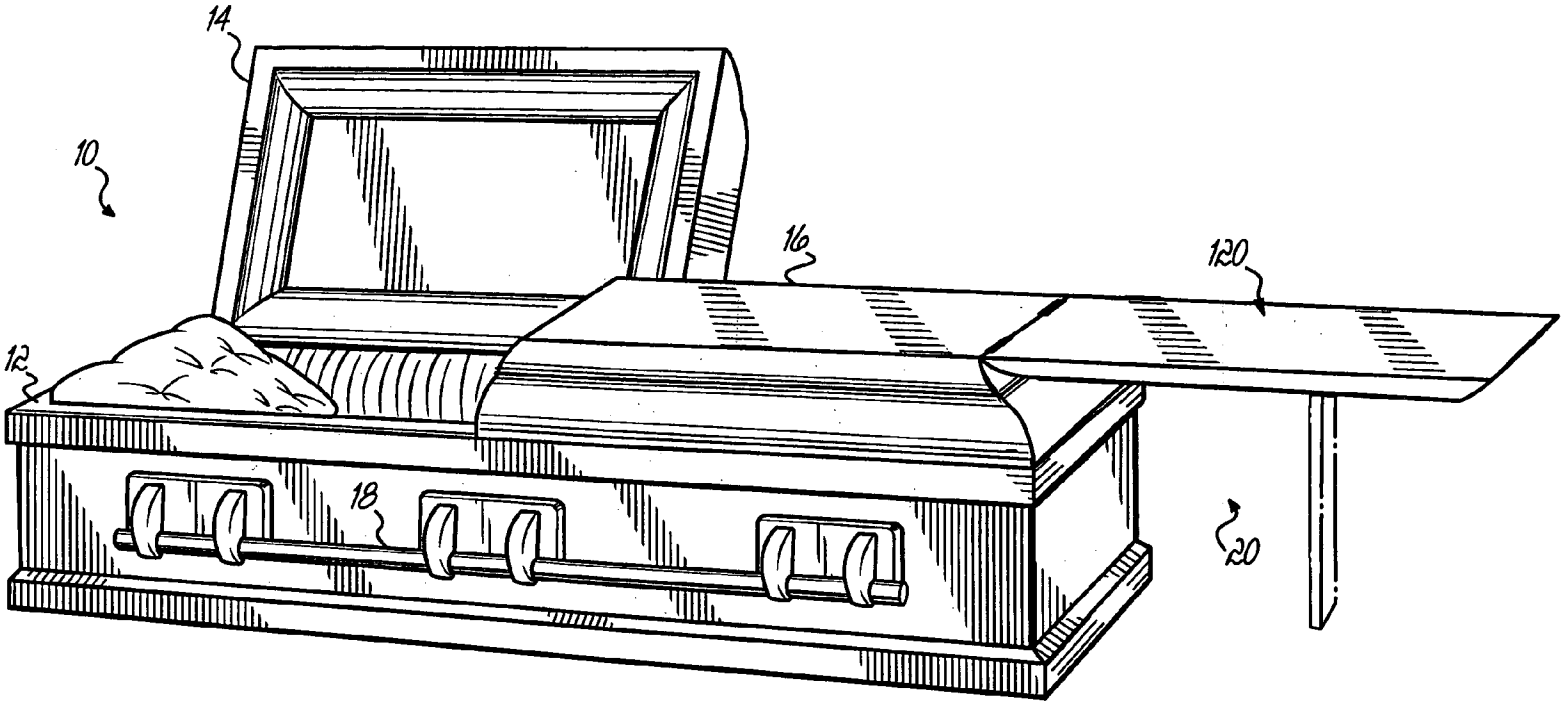

Referring to FIGS. 11A and 11B, foot end lid 16 includes an upper portion forming a shelf 120 pivoted to a lower portion of the lid 16 at a foot end edge thereof. Shelf 120 is deployed by pivoting it relative to the lower portion of the lid 16.

Figure 12A:
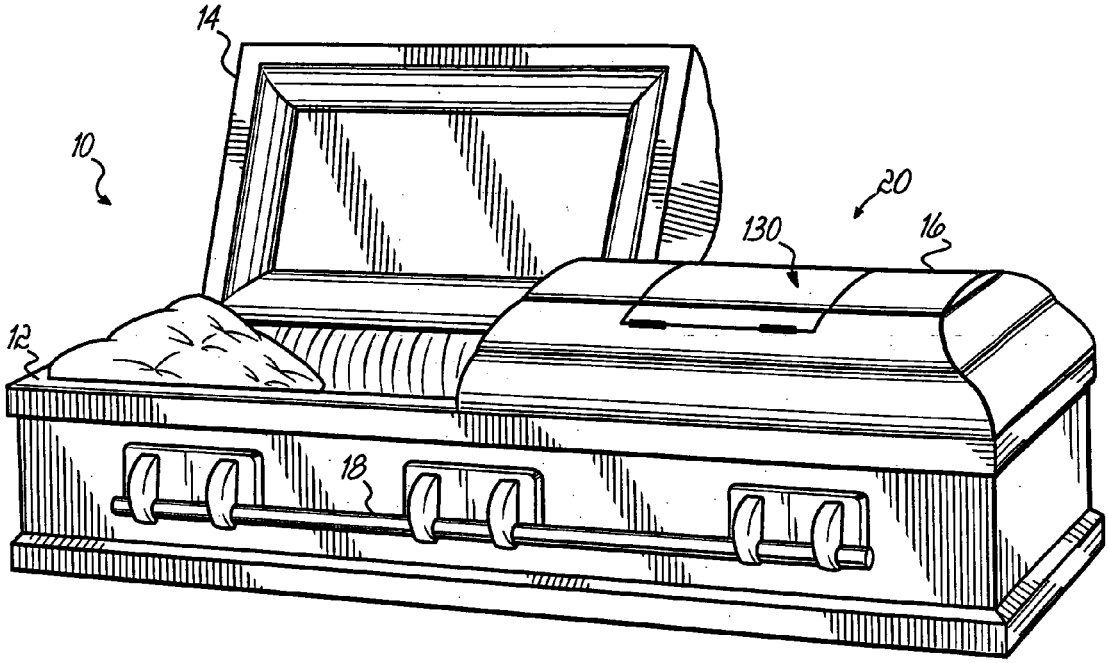
FIGS. 12A and 12B are perspective views of another embodiment.
Figure 12B:
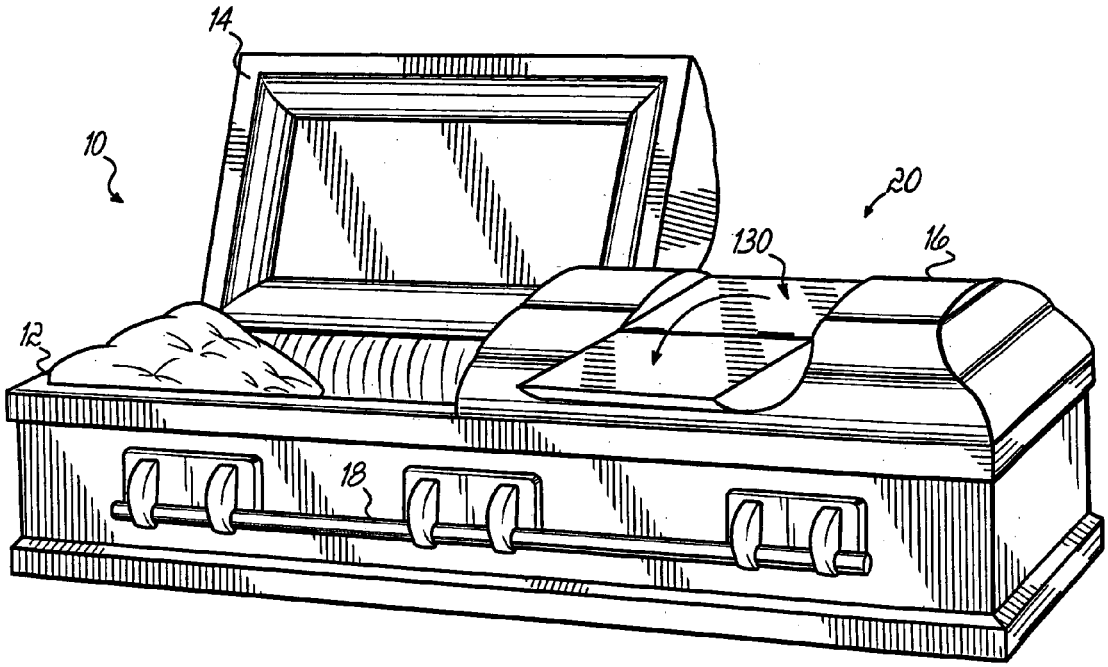

Referring to FIGS. 12A and 12B, foot end lid 16 includes an upper portion forming a shelf 130 pivoted to a lower portion of the lid 16 at a forward side edge thereof. Shelf 130 is deployed by pivoting it relative to the lower portion of the lid 16.

Figure 13:
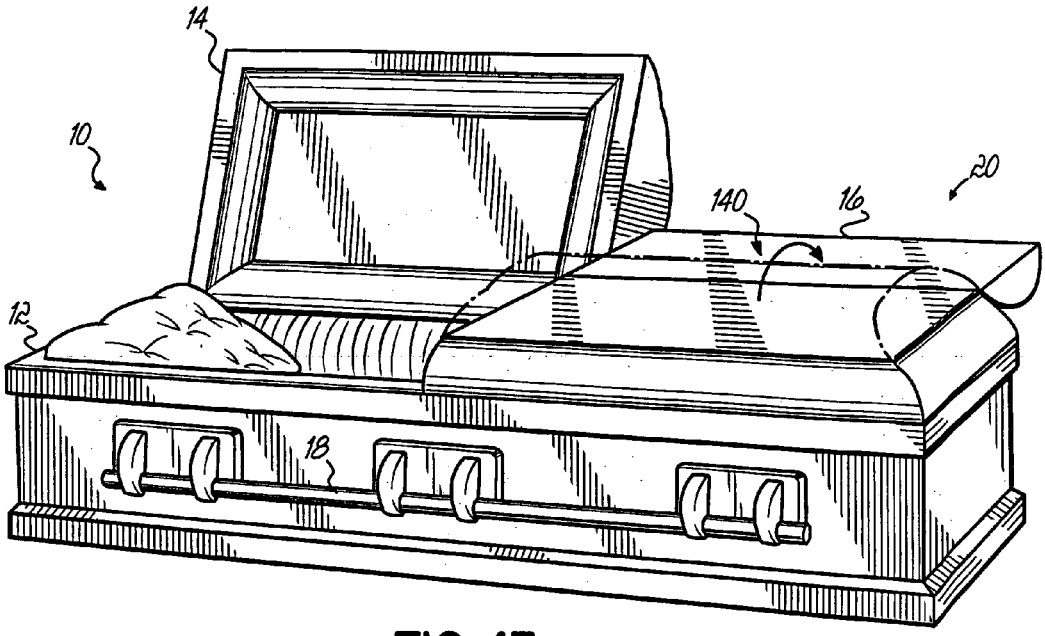
FIG. 13 is a perspective view of another embodiment.

Referring to FIG. 13, foot end lid 16 includes an upper portion forming a shelf 140 pivoted to a lower portion of the lid 16 at a rearward side thereof. Shelf 140 is deployed by pivoting it relative to the lower portion of the lid 16.

Figure 14A:
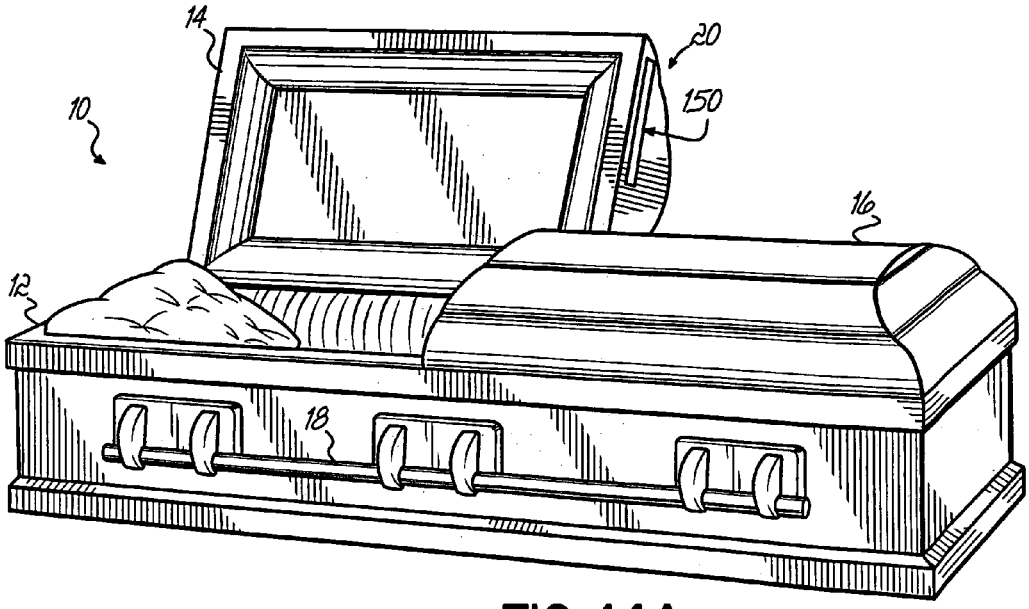
FIGS. 14A and 14B are perspective views of another embodiment.
Figure 14B:
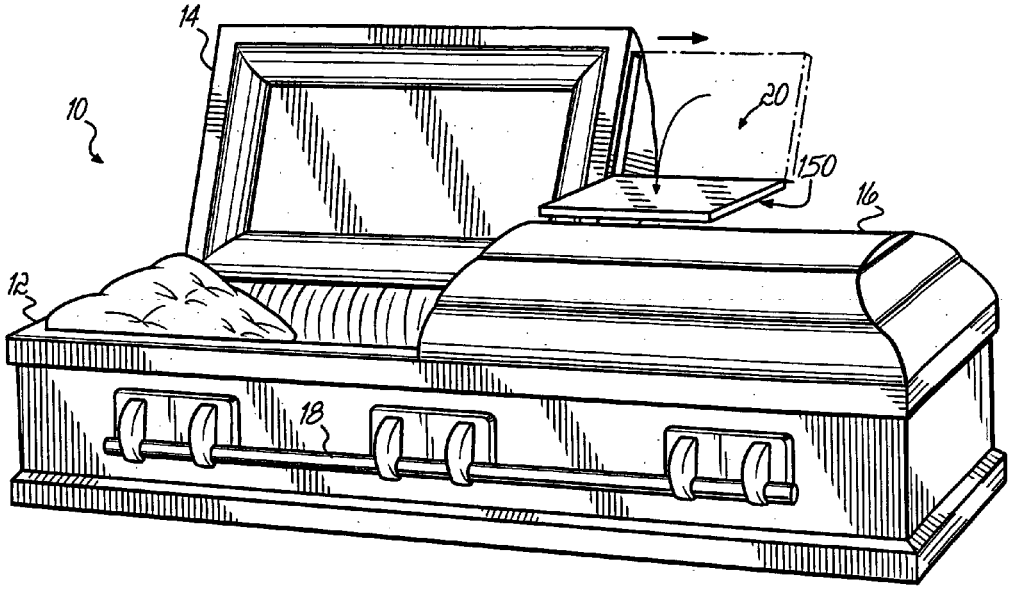

Referring to FIGS. 14A and 14B, head end lid 14 includes a shelf 150 which is both slidably and pivotally mounted therein. Shelf 150 is deployed by first opening head end lid 14, sliding the shelf 150 out of the lid 14 and then pivoting the shelf 150 downwardly relative to the lid 14.

Figure 15A:
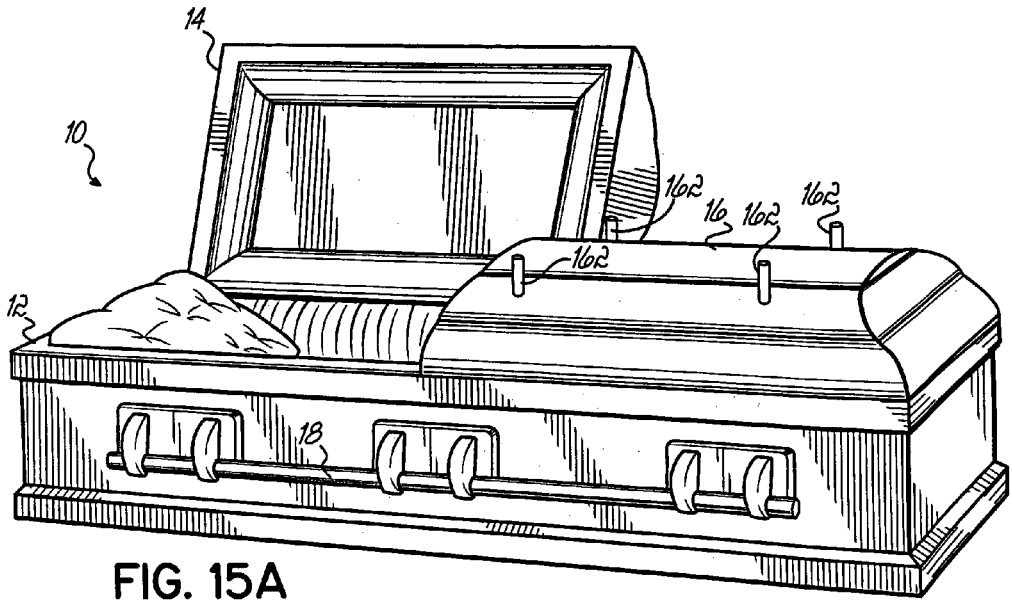
FIGS. 15A and 15B are perspective views of another embodiment.
Figure 15B:
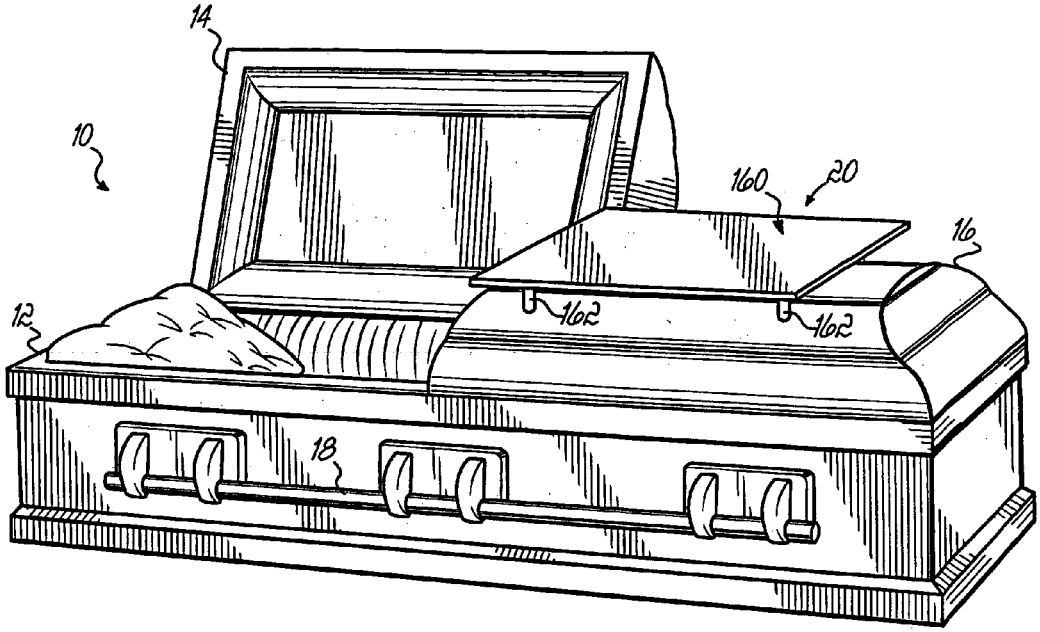

Referring to FIGS. 15A and 15B, foot end lid 16 includes a shelf 160 mounted atop four posts 162, themselves mounted to an upper surface of lid 16.

Figure 16:
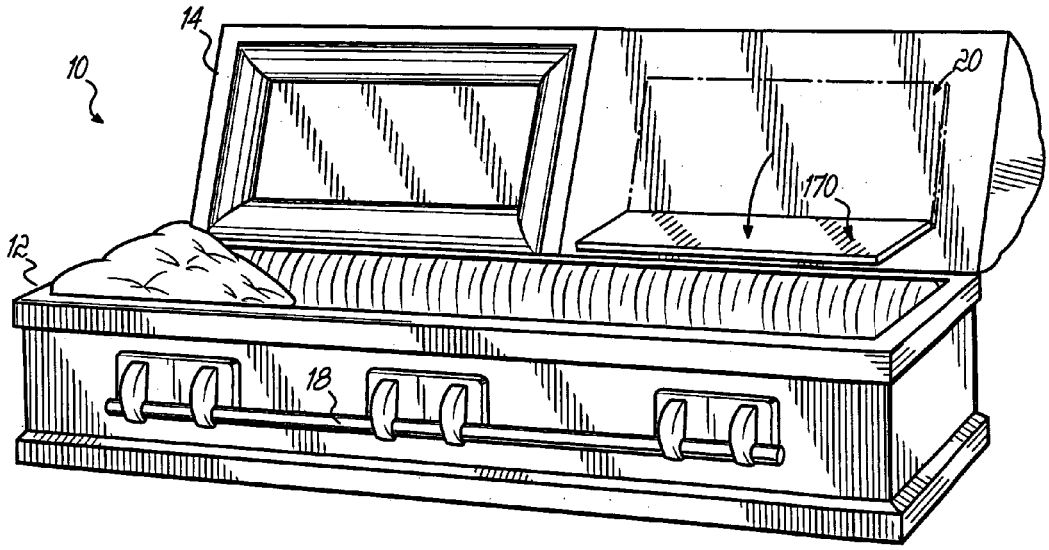
FIG. 16 is a perspective view of another embodiment.

Referring to FIG. 16, foot end lid 16 (as illustrated) includes a shelf 170 pivotally mounted to an underneath side of the lid 16 along a lower edge of the shelf 170. Shelf 170 is deployed by opening the foot end lid 16 and pivoting the shelf 170 downwardly relative to the lid 16.

Figure 17A:
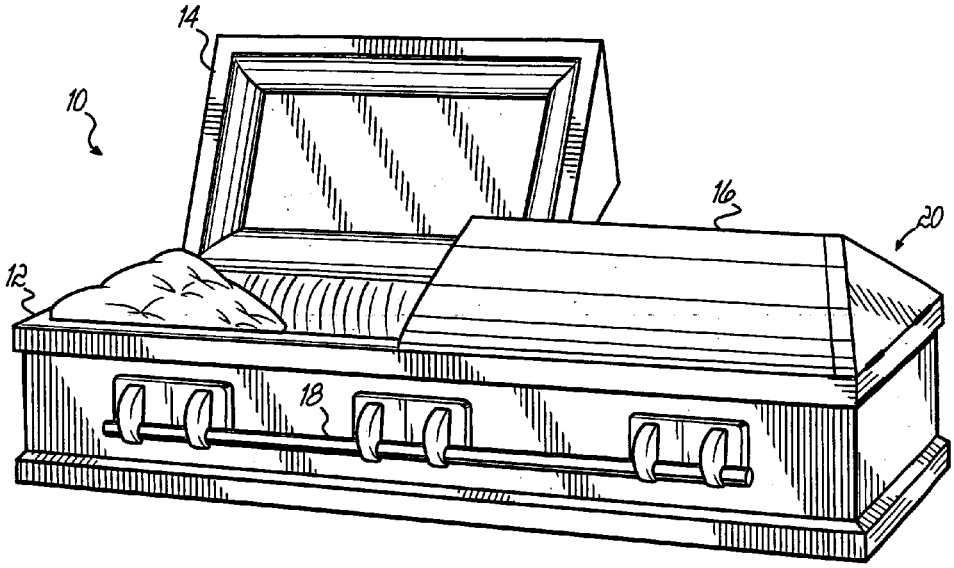
FIG. 17A-17C are perspective views of another embodiment.
Figure 17B:
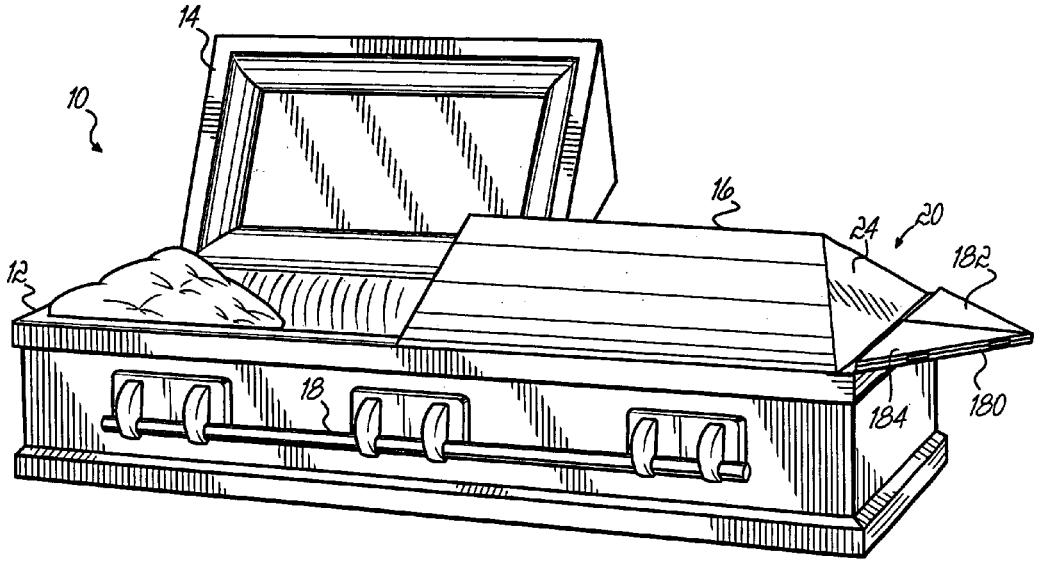
Figure 17C:
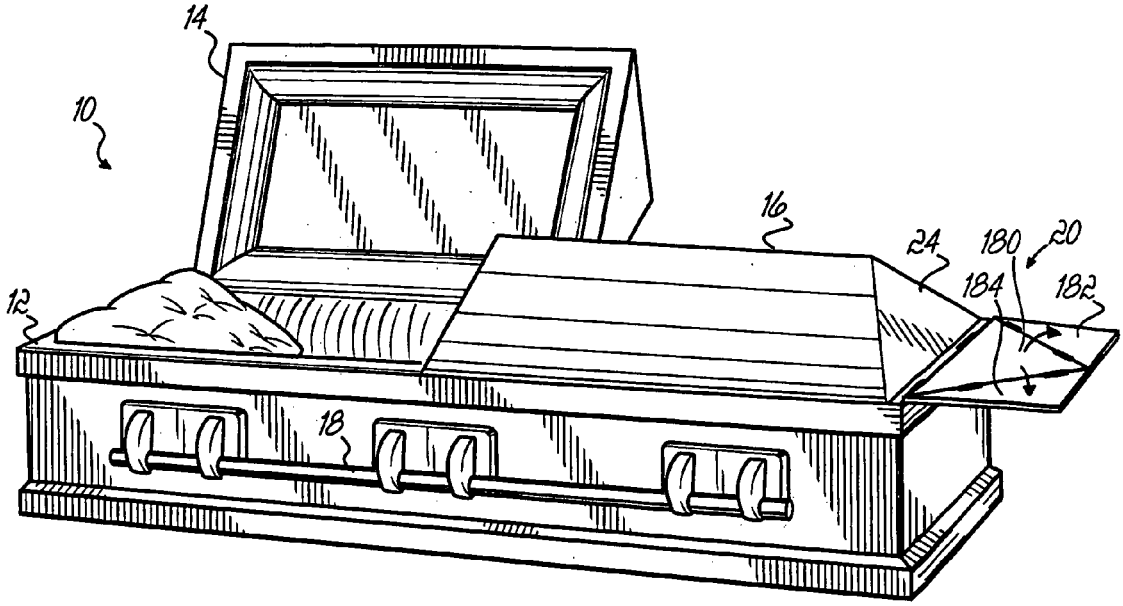

Referring to FIGS. 17A-17C, foot end lid 16 includes an end panel 24 and a shelf 180 pivotally mounted to end panel 24 along a lower edge of the shelf 180. The shelf 180 is adapted to be deployed by pivoting the shelf 180 away from the end panel 24. The shelf can comprise three sections, first section 180 pivoted to end panel 24, and second and third sections 182, 184 pivoted to the first section 180 at opposite side edges of the first section 180. In that case the shelf is deployed by pivoting the first section 180 away from the end panel 24 and by pivoting the second and third sections 182, 184 relative to the first section 180 to thereby form a substantially planar shelf out of the first, second and third sections.

Figure 18:
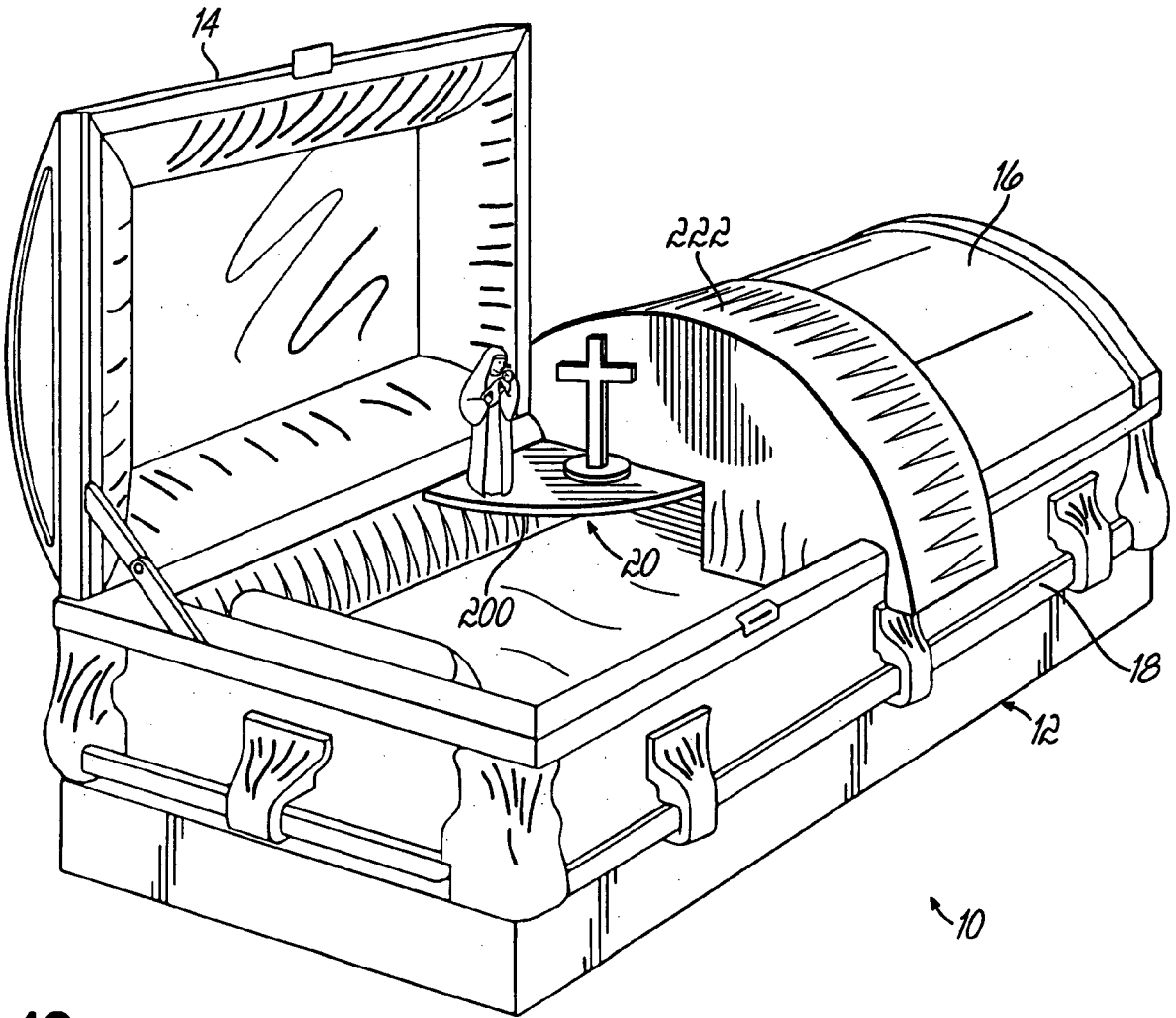
FIG. 18 is a perspective view of another embodiment with head end lid open and foot end lid closed, and with the memorial shelf extended.
Figures 19, 19A:
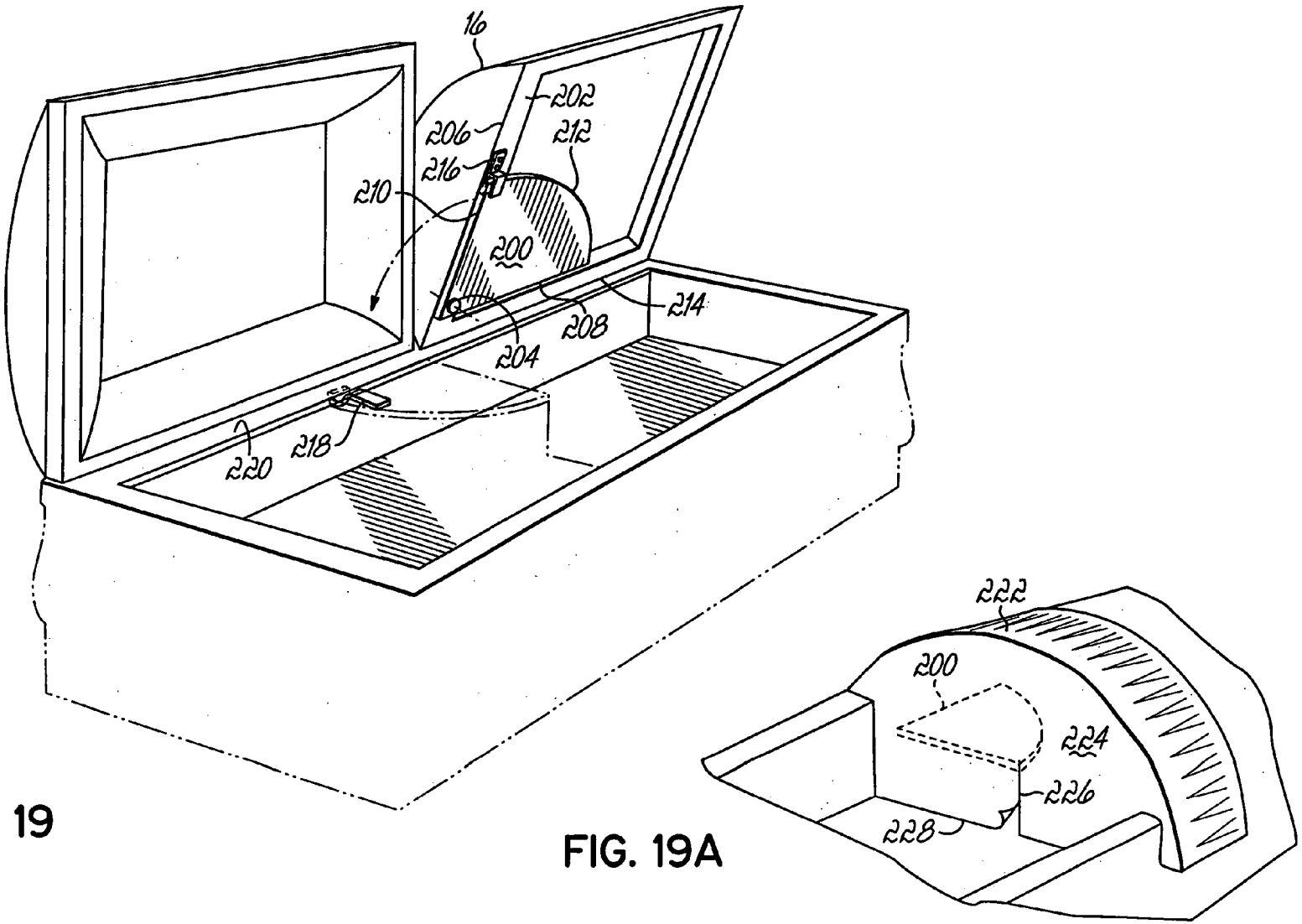
FIG. 19 is a view similar to FIG. 18 but with the foot end lid also open and the memorial shelf retracted.
FIG. 19A is a partial perspective view, similar to FIG. 18, but with the memorial shelf retracted.

Referring now to FIGS. 18, 19, and 19A, there is illustrated another embodiment of deployable structure 20 which, when deployed, defines a memorial surface adapted to have placed thereon items of memorialization. More particularly, a memorial shelf 200 is pivoted to one of the lids 14, 16 and is movable to and between an extended position (FIG. 18) at which said shelf 200 is adapted to support items of memorialization and a retracted position (FIG. 19).

The lid to which the shelf 200 is mounted, for example foot end lid 16, can have a downwardly facing flange 202 to which the shelf 200 can be pivoted as at pivot 204. The shelf 200 can be pivoted to the foot end lid flange 202 adjacent a head end edge 206 thereof. The shelf 200 can be pie-shaped. The pie-shaped shelf 200 can have two straight sides 208, 210, and an arcuate side 212. The shelf 200 can be pivoted to the foot end lid 16 adjacent where the two straight sides 208, 210 intersect. The foot end lid 16 can be pivoted to the shell 12 with hinges (not shown) along a hinge side 214 of the lid 16. The pie-shaped shelf 200 can be pivoted to the foot end lid 16 adjacent the hinge side 214 of the lid 16. The lid 16 can include a brace 216 which supports the shelf 200 when in the extended and/or retracted position. The shell 12 can include a brace 218, for example a removable brace 218 which fits over or otherwise removably attaches to an edge 220 of shell which supports the shelf 200 when in the extended position. The brace 218 and shelf 200 can include cooperating locking structure, for example, a detent type mechanism wherein one of the shelf 200 and brace 218 include one or more nubs or protuberances thereon, and the other of the shelf 200 and brace 218 include one or more recesses for the nubs or protuberances to engage, thereby locking the shelf 200 into place.

Referring to FIGS. 18 and 19A, an overthrow 222 can overlie the head end portion of the foot end lid 16 and can have a skirt 224 which drapes downwardly from the lid 16 and into the shell 12 for concealing the legs of a deceased therein. Skirt 224 can include a slit 226 therein extending upwardly from a lowermost edge 228 of the skirt 224 of the overthrow 222. The portion of the skirt 224 on the side of the shelf 200 can be folded back underneath the head end portion of the foot end lid 16 between it and the shelf 200 during the time that the shelf 200 is in the extended position. When in the retracted position, that portion of the skirt 224 can be allowed to hand downwardly into the shell 12, thereby concealing the shelf 200.

Those skilled in the art will recognize that numerous adaptations and modifications can be made to the present invention which will result in an improved memorialization casket, yet all of which will fall within the spirit and scope of the present invention as defined in the following claims. For example, the memorialization shelf would not have to be pivoted to the lid to be within the scope of the invention. The shelf could be supported between the lid and the shell flange with or without braces, pins, etc. The shelf could be supported on a block, for example, polystyrene block, supported by the bed of the casket. The shelf could be supported on a bracket or brace attached to the carrying handle of the casket and extending over the body. The shelf could be supported on a bracket or brace extending from one side flange of the shell to the other side flange of the shell. Accordingly, the invention is to be limited only by the scope of the following claims and their equivalents.

What is claimed is:

1. A casket comprising:

a casket shell;

a casket lid closeable upon said shell and having a downwardly facing flange; and a memorial shelf pivoted to said lid and movable in a plane generally parallel to a plane defined by said lid flange to and between an extended position at which said shelf is adapted to support items of memorialization and a retracted position.

2. The casket of claim 1 wherein:

said casket lid includes head and foot end lids;

said shelf is pivoted to said foot end lid; and said shelf and lids are configured such that said shelf is moveable to the extended position when said head end lid is open and said foot end lid is closed.

3. A casket comprising:

a casket shell;

a casket lid closeable upon said shell; and a memorial shelf pivoted to said lid and movable to and between an extended position at which said shelf is adapted to support items of memorialization and a retracted position;

wherein said lid has a downwardly facing flange and wherein said shelf is pivoted to said lid flange.

4. The casket of claim 3 wherein said casket lid includes head and foot end lids and wherein said shelf is pivoted to said foot end lid.

5. The casket of claim 4 wherein said foot end lid has said downwardly facing flange and wherein said shelf is pivoted to said foot end lid flange.

6. The casket of claim 5 wherein said shelf is pivoted to said foot end lid flange adjacent a head end edge thereof.

7. The casket of claim 4 wherein said shelf is pie-shaped.

8. The casket of claim 7 wherein said pie-shaped shelf has two straight sides and an arcuate side, and wherein said shelf is pivoted to said foot end lid adjacent where said two straight sides intersect.

9. The casket of claim 8 wherein said foot end lid is pivoted to said shell with hinges along a hinge side of said lid and wherein said pie-shaped shelf is pivoted to said foot end lid adjacent said hinge side of said lid.

10. The casket of claim 3 wherein said lid includes a brace which supports said shelf when in the extended position.

11. The casket of claim 3 wherein said shell includes a removable brace which supports said shelf when in the extended position.

12. A casket comprising:

a casket shell;

head end and foot end casket lids closeable upon said shell; and a memorial shelf pivoted to said foot end lid and movable to and between an extended position at which said shelf is adapted to support items of memorialization and a retracted position.

13. The casket of claim 12 wherein said foot end lid has a downwardly facing flange and wherein said shelf is pivoted to said foot end lid flange.

14. The casket of claim 13 wherein said shelf is pivoted to said foot end lid flange adjacent a head end edge thereof.

15. The casket of claim 14 wherein said shelf is pie-shaped.

16. The casket of claim 15 wherein said pie-shaped shelf has two straight sides and an arcuate side, and wherein said shelf is pivoted to said foot end lid adjacent where said two straight sides intersect.

17. The casket of claim 16 wherein said straight sides form an angle therebetween of about 90 degrees.

18. The casket of claim 14 wherein said foot end lid is pivoted to said shell with hinges along a hinge side of said lid and wherein said shelf is pivoted to said foot end lid adjacent said hinge side of said lid.

19. The casket of claim 18 wherein said foot end lid has a free side and said shelf, when extended, extends less than entirely from said hinge side of said foot end lid to said free side of said foot end lid.

20. The casket of claim 19 further including an overthrow having a first section overlying an upwardly facing surface of said foot end lid and a second section extending downwardly from a head end edge of said first section downwardly into said shell, and wherein said second section includes a generally vertically oriented slit therein permitting that portion of said second section which corresponds to said shelf to be tucked in behind said shelf when said shelf is in the extended position.

21. The casket of claim 13 wherein said lid includes a brace attached to said downwardly facing flange which supports said shelf when in the extended position.

22. The casket of claim 12 wherein said shell includes a removable brace which supports said shelf when in the extended position.

23. A casket comprising:

a casket shell;

a casket lid closeable upon said shell and having a downwardly facing flange; and a memorialization shelf pivoted to at least one of said shell and said lid, said memorialization shelf being movable in a plane generally parallel to a plane defined by said lid flange to and between an extended position where said shelf is adapted to support items of memorialization for display, and a retracted position where the items of memorialization cannot be supported thereon.

24. The casket of claim 23 wherein said memorialization shelf structure is pivoted to said lid.

25. A casket comprising:

a casket shell;

a casket lid closeable upon said shell; and a memorialization shelf operably associated with said lid, said memorialization shelf being movable to and between an extended position where said shelf is adapted to support items of memorialization for display, and a retracted position where the items of memorialization cannot be supported thereon;

wherein said lid has a downwardly facing flange and wherein said shelf is pivoted to said lid flange.

26. The casket of claim 25 wherein said casket lid includes head and foot end lids and wherein said shelf is pivoted to said foot end lid.

27. The casket of claim 26 wherein said foot end lid has said downwardly facing flange and wherein said shelf is pivoted to said foot end lid flange.

28. The casket of claim 27 wherein said shelf is pivoted to said foot end lid flange adjacent a head end edge thereof.

29. The casket of claim 25 wherein said shelf is pie-shaped.

30. The casket of claim 29 wherein said pie-shaped shelf has two straight sides and an arcuate side, and wherein said shelf is pivoted to a foot end lid of said lid adjacent where said two straight sides intersect.

31. The casket of claim 30 wherein said foot end lid is pivoted to said shell with hinges along a hinge side of said lid and wherein said pie-shaped shelf is pivoted to said foot end lid adjacent said hinge side of said lid.

32. The casket of claim 25 wherein said lid includes a brace which supports said shelf when in the extended position.

33. The casket of claim 25 wherein said shell includes a removable brace which supports said shelf when in the extended position.

* * * * *